United States Patent [19]

Kobayashi et al.

[11] Patent Number: 4,466,316

[45] Date of Patent: Aug. 21, 1984

[54] PHOTOGRAPHIC FILM TRAILING END CUTTING METHOD AND APPARATUS

[75] Inventors: Kazuhiko Kobayashi; Eiichi Kito; Nobuo Watase; Kaoru Uchiyama, all of Kanagawa, Japan

[73] Assignee: Fuji Photo Film Co., Ltd., Kanagawa, Japan

[21] Appl. No.: 316,028

[22] Filed: Oct. 28, 1981

[30] Foreign Application Priority Data

Oct. 31, 1980 [JP] Japan ..... 55-152190

[51] Int. Cl.[3] ..... G03D 15/04

[52] U.S. Cl. ..... 83/13; 83/364; 83/369; 83/372

[58] Field of Search ..... 83/13, 175, 649, 370, 83/371, 211, 372, 290, 291, 292, 364, 369; 242/56 R, 56 B, 75.4, 75.43, 75.44

[56] References Cited

U.S. PATENT DOCUMENTS

| | | | |
|---|---|---|---|
| 3,304,822 | 2/1967 | Barnes et al. | 83/364 |
| 3,682,543 | 8/1972 | Iwamoto | 83/649 |
| 3,699,809 | 10/1972 | Komatsu | 242/75.44 |
| 3,807,264 | 4/1974 | Jessop | 83/175 |
| 3,835,745 | 9/1974 | Basu et al. | 83/175 |
| 3,868,877 | 3/1975 | Shoji et al. | 83/371 |
| 3,948,125 | 4/1976 | Hujer et al. | 83/364 |
| 4,056,024 | 11/1977 | Beart et al. | 83/371 |

*Primary Examiner*—Frank T. Yost
*Assistant Examiner*—Hien H. Phan
*Attorney, Agent, or Firm*—Sughrue, Mion, Zinn, Macpeak, and Seas

[57] ABSTRACT

In a film cutter which is activated at the end of the film by a film end detection signal, the length of film transported is monitored and the cutter is activated only if the film end detection signal occurs during predetermined ranges of film length.

6 Claims, 4 Drawing Figures

PHOTOGRAPHIC FILM TRAILING END CUTTING METHOD AND APPARATUS

BACKGROUND OF THE INVENTION

This invention relates to a method of cutting the trailing end of a photographic film strip pulled out of a spool, and to an apparatus for practicing the method.

When photographic films pulled out of spools are spliced, the trailing end of film must be cut. This cutting operation has heretofore been carried out according to a method in which a trailing end detecting switch is operated by the utilization of the tension which occurs in the photographic film when the film has been fully pulled out of the spool, so that a trailing end cutting means is operated in response to a detection signal from the trailing end detecting switch. However, this method is disadvantageous in that if there is some defect in the photographic film it is not possible to pull the picture film smoothly out of the spool. Accordingly, tension may occur in the film during the film pulling operation, as a result of which the film is sometimes cut undesirably in its central portion.

SUMMARY OF THE INVENTION

Accordingly, an object of this invention is to provide a method of cutting the trailing end of a photographic film in which the central portion of the photographic film will not be erroneously cut because of the tension which is applied to the photographic film strip during the film pulling operation.

The foregoing object of the invention has been achieved according to this invention by the provision of a method of cutting the trailing end of a film strip in which the end trailing detecting means is operated only when the length of the film pulled out of the spool is within a predetermined range of length.

For instance, three kinds of 135 type films of different lengths are available; that is, 35 mm films having twelve exposures (12 EX) and 693.5 mm in total lenth, twenty-four exposures (24 EX) and 1149.5 mm in total length and thirty-six exposures (36 EX) and 1605.5 mm in total length are available. For each of these three kinds of 135 type films, all manufacturers employ the same total length, but different makers employ various lengths for the leading end portions of the films where decorative characters are formed, and therefore the lengths of the leading end portions to be cut are different—47.5 mm to 95.0 mm—depending on the manufacturers. The length of the trailing end portion to be cut is always set to the same value, for instance 12 mm, by the manufacturers. Therefore, the length of the film to be spliced before it is subjected to development, i.e. the length of the film after the leading end is cut off which is obtained before the trailing end portion reached is 586.5 mm to 634 mm in the case of a 12 EX 35 mm film, 1042.5 mm to 1090 mm in the case of a 24 EX 35 mm film, and 1498.5 mm to 1546 mm in the case of 36 EX 35 mm film.

Therefore, if the trailing end cutting means is operated only when a film is pulled over one of these length ranges of 586.5 mm to 634 mm, 1042.5 mm to 1090 mm and 1498.5 mm to 1546 mm after its leading end is cut off and the trailing end of the film is detected from the tension which is given to the film, then the trailing end of the film can be cut correctly at all times.

BRIEF DESCRIPTION OF THE DRAWINGS

One preferred embodiment of this invention will now be described with reference to the accompanying drawings, in which.

DETAILED DESCRIPTION OF THE INVENTION

Figure 1:
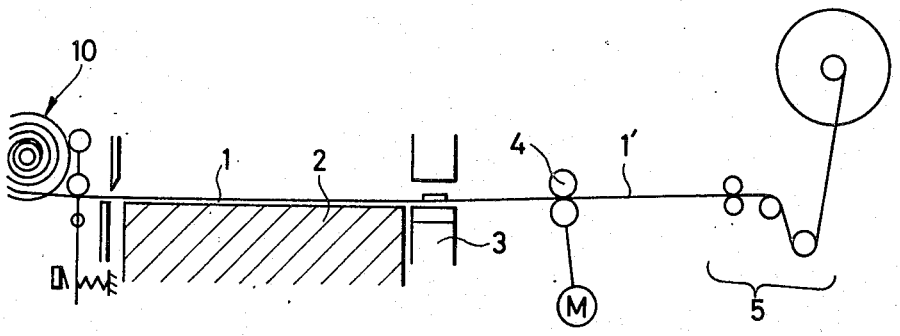
FIG. 1 is a schematic sectional view showing one embodiment of this invention.

FIG. 1 is a sectional view showing one example of a method of detecting the trailing end of a photographic film strip according to this invention. As shown in FIG. 1, a photographic film 1 is pulled out of a cartridge 10 from which the outside metal member has been removed, and is then laid on an insertion deck 2. The leading end of the film 1 thus laid is cut with a film end cutter (not shown), and the cut film 1 is spliced to the trailing end of the preceding film 1' on a splicing stand 3. Under this condition, the photographic film 1 can be moved by a feed roller 4 which is preferably driven by a pulse motor M.

Figure 2:
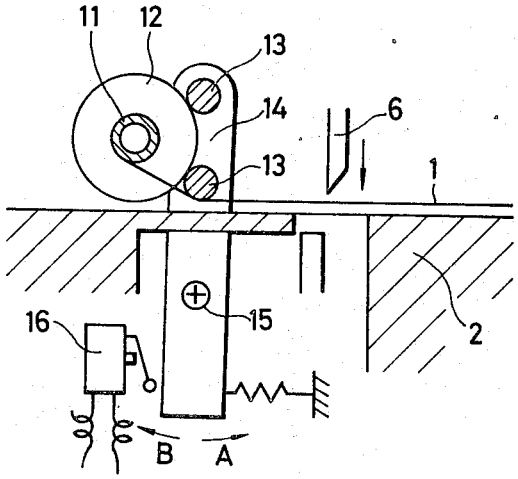
FIG. 2 is a schematic enlarged view of a first trailing end detecting means in FIG. 1.

FIG. 2 is an enlarged view showing a photographic film which has been fully unwound from the spool core 11 of the cartridge 10, i.e. fully pulled out of the cartridge 10. A rotary lever 14 has guide rods 13 which extend horizontally, the lever 14 is elastically urged to turn about a shaft 15 in the direction of the arrow A. Upon application of tension to the film 1 at the end of the strip, a flange 12 of the cartridge 10 is pulled in the film running direction, so that the rotary lever 14 is turned in the direction of the arrow B, as a result of which switch 16 is turned on to produce a trailing end detection output. A first trailing end detecting means operates in this manner.

Figure 3:
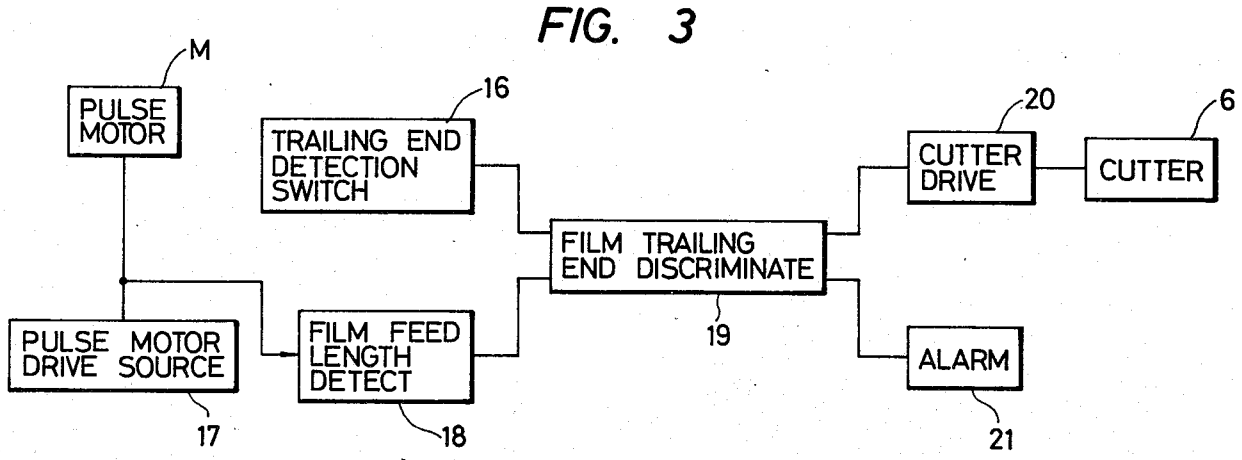
FIG. 3 is a block diagram showing an embodiment of the invention.
Figure 4:
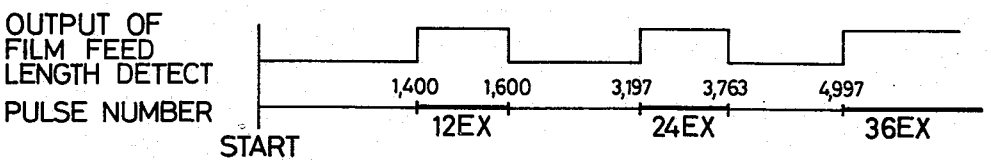
FIG. 4 is a diagram showing the relationships between the numbers of pulses and square wave signals in the circuitry of FIG. 3.

The case where, in addition to the first trailing end detecting means, a second trailing end detecting means is employed, will be described with reference to FIG. 3. In this case, the pulse motor M is used to feed the photographic film, and the number of pulses applied to the pulse motor from a pulse motor drive signal source 17 is counted by a pulse number detector. In order to cut the film 1 to its proper length, the amount of feed of the film per pulse is set to 0.254 mm/pulse, for instance. Thus, the ranges of pulses 1400 to 1666, 3197 to 3463 and more than 4996 correspond respectively to the film lengths, the pulse ranges being obtained by subtraction from the total length of the film of the number of pulses which corresponds to the length (for instance 211 mm) of the insertion deck, i.e. the length from the trailing cutting means 6 to the splicing point. These ranges cover the differences in length of the different manufacturers' films and the personal errors of the different operators. When its count value is within one of these ranges, signals are outputted by a film feed length detecting circuit 18 as shown in FIG. 4. This signal from the detecting circuit 18 is applied to a film trailing end discriminating circuit 19 which will then drive the cutter 6 through a cutter drive circuit 20 when the switch 16 of the first detecting means is turned on by the tension of the film. When the film is not smoothly run, for instance when it snags, the trailing end detecting switch 16 is turned on by the film tension, but in this case, the film trailing end detecting circuit 19 provides an output which activates an alarm 21 rather than the cutter 6.

In the above-described embodiment, a pulse motor is employed, but it goes without saying that the object of this invention can be achieved using any means for detecting the film length, such as a drive system using a cam plate capable of detecting the film length.

The trailing end detecting device according to this invention can most advantageously be used with a photographic film splicer (Japanese Patent Application No. 119207/1980 filed in Japan by the present applicant on Aug. 29, 1980) which, in order to develop exposed films, efficiently and successively splices the films from various film cartridges into a single long film.

What is claimed is:

1. A method of cutting a photographic film wherein the film is pulled out of a cartridge and is transported past a cutting means and is cut by said cutting means, comprising the steps of:

utilizing tension which occurs in the film as the film is pulled out of the cartridge to generate a first detection signal which is transmitted to said cutting means;

detecting a length of said film transported past said cutting means;

generating a second detection signal and transmitting said second detection signal to said cutting means when said detected length is within a predetermined range;

enabling said cutting means which then cuts said film only in response to receipt of said first and second detection signals.

2. The method of claim 1, wherein said second detection signal is generated and transmitted only when said detected length is within any one of three separate sub-ranges in said predetermined range.

3. An apparatus for cutting the trailing end of a photographic film pulled from a film holder as it is transported past a cutting station, said apparatus of the type comprising cutting means at said cutting station for cutting said film when activated, comprising:

tension detecting means for providing a first detection signal in response to the detection of tension in said film, said tension detecting means including a rotary lever having guide rods extending outward therefrom on one end of said lever opposite a pivot therefor, said guide rods being engaged with a cartridge when said cartridge is pulled in a film running direction, a switch being selectively engaged with an opposite end of said lever, and means for biasing said opposite end of said lever away from said switch, engagement between said guide rods and said cartridge caused by tension in said film causing said opposite end of said lever to engage said switch which generates said first detection signal;

length detecting means for providing a second detection signal in response to the detection of predetermined length of film transported past said cutting means, said predetermined length being within a predetermined range; and means activating said cutting means which then cuts said film only in response to receipt of said first and second signals.

4. An apparatus as claimed in claim 3, wherein said predetermined range comprising three separate predetermined sub-ranges.

5. An apparatus as claimed in claim 4, wherein each of said sub-ranges is less than approximately 50 mm in length.

6. An apparatus as claimed in claim 3, wherein said length detecting means counts pulses corresponding to film length movement, and provides an output signal when its count value is within said predetermined range.

* * * * *